US008074633B2

(12) United States Patent
Grant et al.

(10) Patent No.: US 8,074,633 B2
(45) Date of Patent: Dec. 13, 2011

(54) BALL PROJECTING MACHINE

(75) Inventors: Eugene Grant, Reno, NV (US); William R. Woessner, Chicago, IL (US); Ian Fettes, June Lake, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 317 days.

(21) Appl. No.: 12/386,020

(22) Filed: Apr. 14, 2009

(65) Prior Publication Data

US 2009/0260612 A1 Oct. 22, 2009

Related U.S. Application Data

(60) Provisional application No. 61/124,370, filed on Apr. 16, 2008.

(51) Int. Cl.
*A63B 69/00* (2006.01)

(52) U.S. Cl. ..... 124/78

(58) Field of Classification Search ..... 124/78, 124/6, 80; 473/422, 451, 431, 415, 416, 473/436; 273/317.6, 317.4, 108.3
See application file for complete search history.

(56) References Cited

U.S. PATENT DOCUMENTS

| | | | | |
|---|---|---|---|---|
| 4,193,591 | A * | 3/1980 | Paulson | 124/78 |
| 4,632,088 | A | 12/1986 | Bruce | 124/78 |
| 4,676,504 | A | 6/1987 | Ponza | 124/7 |
| 4,760,835 | A * | 8/1988 | Paulson et al. | 124/78 |
| 4,823,763 | A | 4/1989 | Ponza | 124/78 |
| 4,890,834 | A | 1/1990 | Ponza | 473/421 |
| D356,842 | S | 3/1995 | Trapp | D21/720 |
| 5,832,909 | A | 11/1998 | Grant et al. | 124/6 |
| 5,865,161 | A | 2/1999 | Bruce | 124/78 |
| 6,093,117 | A | 7/2000 | Sherlock et al. | 473/422 |
| 6,190,271 | B1 | 2/2001 | Rappaport et al. | 473/451 |
| 6,202,636 | B1 | 3/2001 | O'Brien | 124/71 |
| 6,237,583 | B1 | 5/2001 | Ripley et al. | 124/78 |
| 6,401,704 | B1 | 6/2002 | Caldwell | 124/78 |
| 6,427,675 | B1 | 8/2002 | Caldwell et al. | 124/78 |
| 6,440,013 | B1 | 8/2002 | Brown | 473/422 |
| 6,443,859 | B1 | 9/2002 | Markin | 473/451 |
| 6,637,422 | B2 | 10/2003 | Wojtkiewicz et al. | 124/78 |
| 6,672,297 | B1 | 1/2004 | Liao | 124/6 |
| 6,732,724 | B1 | 5/2004 | Paulson et al. | 124/6 |
| 6,739,325 | B1 | 5/2004 | Paulson | 124/78 |

* cited by examiner

*Primary Examiner* — Gene Kim
*Assistant Examiner* — Amir Klayman
(74) *Attorney, Agent, or Firm* — Terence P. O'Brien

(57) ABSTRACT

A ball projecting machine having a C-shaped arm that provides the ability to adjust the length or elevation of pitched balls. The C-shaped arm connects a ball projecting head to a stand, with the ball projecting head affixed to one end of the C-shaped arm, and the C-shaped arm is slidably engaged through a frame atop the stand to allow rotation of the ball projecting head about a horizontal axis. A center of gravity of the ball projecting head in combination with the C-shaped arm facilitates stability of the ball projecting machine when the C-shaped arm is slid up or down. A locking device, when loosened, allows the C-shaped arm to slide up or down through the frame.

20 Claims, 4 Drawing Sheets

BALL PROJECTING MACHINE

RELATED U.S. APPLICATION DATA

The present invention claims the benefit of the filing date under 35 U.S.C. §119(e) of U.S. Provisional Patent Application Ser. No. 61/124,370, filed on Apr. 16, 2008, which is hereby incorporated by reference in its entirety.

FIELD OF THE INVENTION

The present invention relates to a ball projecting machine having a C-shaped support arm.

BACKGROUND OF THE INVENTION

Ball projecting machines are widely used by both professional and non-professional athletes for baseball and softball batting practice. Conventional ball projecting or pitching machines typically include either one wheel or two counter-rotating wheels or discs that engage a ball and project the ball toward its intended target. In baseball or softball, ball projecting machines are often used to simulate a pitched ball or a batted ball. When simulating a pitched ball, the ball projecting machine is used to project a ball toward an awaiting batter standing 30 to 60 feet away from the pitching machine. It is often desirable for the pitching machine to accurately place a projected or pitched ball into the batter's strike zone, a portion of the batter's strike zone or to a location just outside of the batter's strike zone. When simulating a batted ball, ball projecting machines are typically used to simulate ground balls, line-drives, pop-ups fly-balls, and other batted ball paths in a variety of heights, directions and speeds. Accordingly, such ball projecting machines often include adjustment capabilities for altering the pitch location or location of the projected ball. Such adjustments are typically achieved by loosening locking handles and then moving the ball projecting head, by hand, on one or more axis points to position the head to throw the type of pitch (spin angle) to the desired location. The ball projecting heads are typically rather sizeable and often heavy thereby making rapid and/or fine adjustments to the ball projecting machine difficult. The user sets the ball projecting head at about the position the user believes is correct, locks it into position, and then turns the machine on to throw pitches or project balls.

After one or more test pitches, the user typically needs to readjust the pitch location by making minor adjustments to move the pitch to the left or right or up or down. Each adjustment requiring loosening and tighting of the locking handles. When simulating batted balls to a one or more players, a user typically desires to rapidly and easily reposition the ball projecting head, to achieve different ball flights for various training exercises or drills.

Adjusting the position of the ball projecting head on conventional pitching machines is an inexact science, with the movements being awkward and often difficult to maneuver. Thus, the adjustments often drastically overshoot or undershoot the desired location. Consequently, this adjustment process often requires numerous tries of locking and unlocking until the machine is throwing to the desired location or series of locations.

It would thus be desirable to provide a ball projecting machine that is capable of being adjusted smoothly and easily to simulate a pitched ball or various paths of batted balls. What is needed is a ball projecting machine that can be rapidly and accurately repositioned to a plurality of positions thereby allowing balls to be projected in a variety of different locations

SUMMARY OF THE INVENTION

The present invention presents a ball projecting machine for projecting balls such as baseballs or softballs. The ball projecting machine features a C-shaped support arm that provides the ability to smoothly and easily adjust the length or elevation of projected or pitched balls.

In one preferred embodiment, the ball projecting machine includes a ball projecting head situated atop a stand, with the ball projecting head including a first wheel spaced apart from an opposing surface by a distance that is slightly less than the diameter of a baseball or softball, and a motor that drives the first wheel. The ball projecting machine also includes a C-shaped arm that connects the ball projecting head to the stand, with the ball projecting head affixed to one end of the C-shaped arm, and the C-shaped arm is slidably engaged through a frame atop the stand to allow rotation of the ball projecting head position about a horizontal axis. More particularly, by sliding the C-shaped arm up or down within the frame of the ball projecting machine, the machine can make longer or shorter, higher or lower pitches. A locking device, when loosened, allows the C-shaped arm to slide up or down through the frame. The locking device may include a press-fit connection that can be engaged and disengaged using a lever, for example.

A center of gravity of the ball projecting head, in combination with the C-shaped arm, facilitates stability of the ball projecting machine when the C-shaped arm is slid up or down, thus providing smooth and easy adjustability. In certain embodiments, the sliding of the C-shaped arm through the frame provides a 180-degree rotation of the ball projecting head position about a horizontal axis to deliver pitches at virtually any height. Furthermore, an area of the C-shaped arm adjacent to the ball projecting head may be flattened in order to produce a vertical pitch. Additionally, the C-shaped arm may include a visible indicator for positioning the ball projecting head. More particularly, a user may note the position of the C-shaped arm with respect to the visible indicator in order to replicate the same type of pitch at a later point in time after the machine has been adjusted for different pitches.

The distance between the first wheel and the opposing surface of the ball projecting head can be adjusted to accommodate different size balls, such as baseballs as well as softballs. For example, the ball projecting machine may include an adjustable pinch pad that can be adjusted to accommodate the different size balls.

The ball projecting machine is suitably constructed of a durable high-tech composite material and steel in order to withstand heavy usage on the playing field. In certain embodiments, for example, the C-shaped arm may be zinc-plated.

The ball projecting head may be rotatable about a vertical axis, and may even be rotatable for a full 360 degrees about the vertical axis. In certain embodiments, the stand includes legs that can be positioned for either baseball or softball. The ball projecting head may be capable of throwing a full range of pitched balls, including fastballs, drop balls, curve balls, sliders, breaking balls, fly balls, pop-ups, catcher's pop-ups, line drives, and grounders.

DETAILED DESCRIPTION OF THE INVENTION

Figure 1:
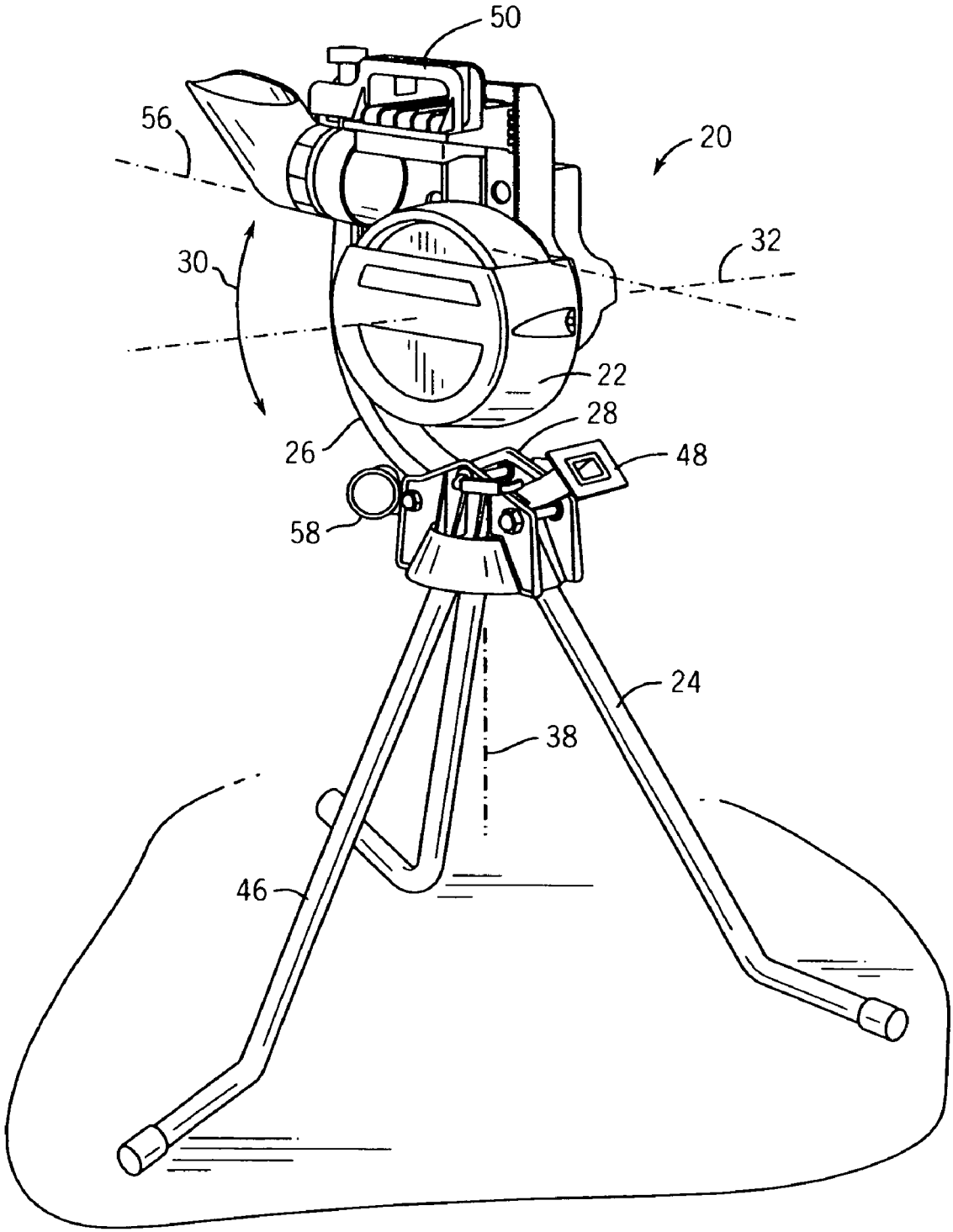
FIG. 1 is a perspective view of a ball projecting machine.

Referring to FIG. 1, a ball projecting machine is indicated generally at 20. A ball projecting head 22 is spaced apart from and situated atop a ball projecting stand 24. In one preferred embodiment, the ball projecting machine 20 is configured to project baseballs and/or softballs. In other embodiment, the ball projecting machine may be configured accommodate other sports balls, such as, for example, tennis balls, soccer balls, footballs, volleyballs, basketballs and lacrosse balls. The ball projecting machine 20 features a generally C-shaped support arm 26 that provides the ability to smoothly and easily adjust the length, angle or elevation of pitched balls 10. The term "C-shaped" refers to a circular or curved shaped article that generally resembles the shape of the letter C. The shape can be semi-circular, a portion of a circle, a portion of an oval or ellipse, or other curved shaped. More particularly, the C-shaped arm 26 couples the ball projecting head 22 to the stand 24, with the ball projecting head 22 affixed to first end of the C-shaped arm 26. The C-shaped arm 26 is slidably engaged through a frame 28 positioned atop the stand 24. The slidable engagement of the C-shaped arm with respect to the frame 28 alters the aim of the ball projecting head 22 as the C-shaped arm 26 is slid through the frame 28. The geometry of the C-shaped arm 26 in tandem with the frame 28 provides a range of angular adjustment of the ball projecting head position of up to 180-degrees rotation about a first axis 32, as demonstrated by arrow 30. In one preferred embodiment, the range of angular adjustment of the ball projecting head about the first axis 32 is at least 90 degrees. In other alternative embodiments, the range of angular adjustment of the ball projecting head about the first axis 32 can at least 135 degrees, at least 155 degrees, and at least 180 degrees. In one preferred embodiment, the first axis 32 is generally horizontal. In other embodiments, the first axis can be angled with respect to horizontal, or vertical.

Figure 2:
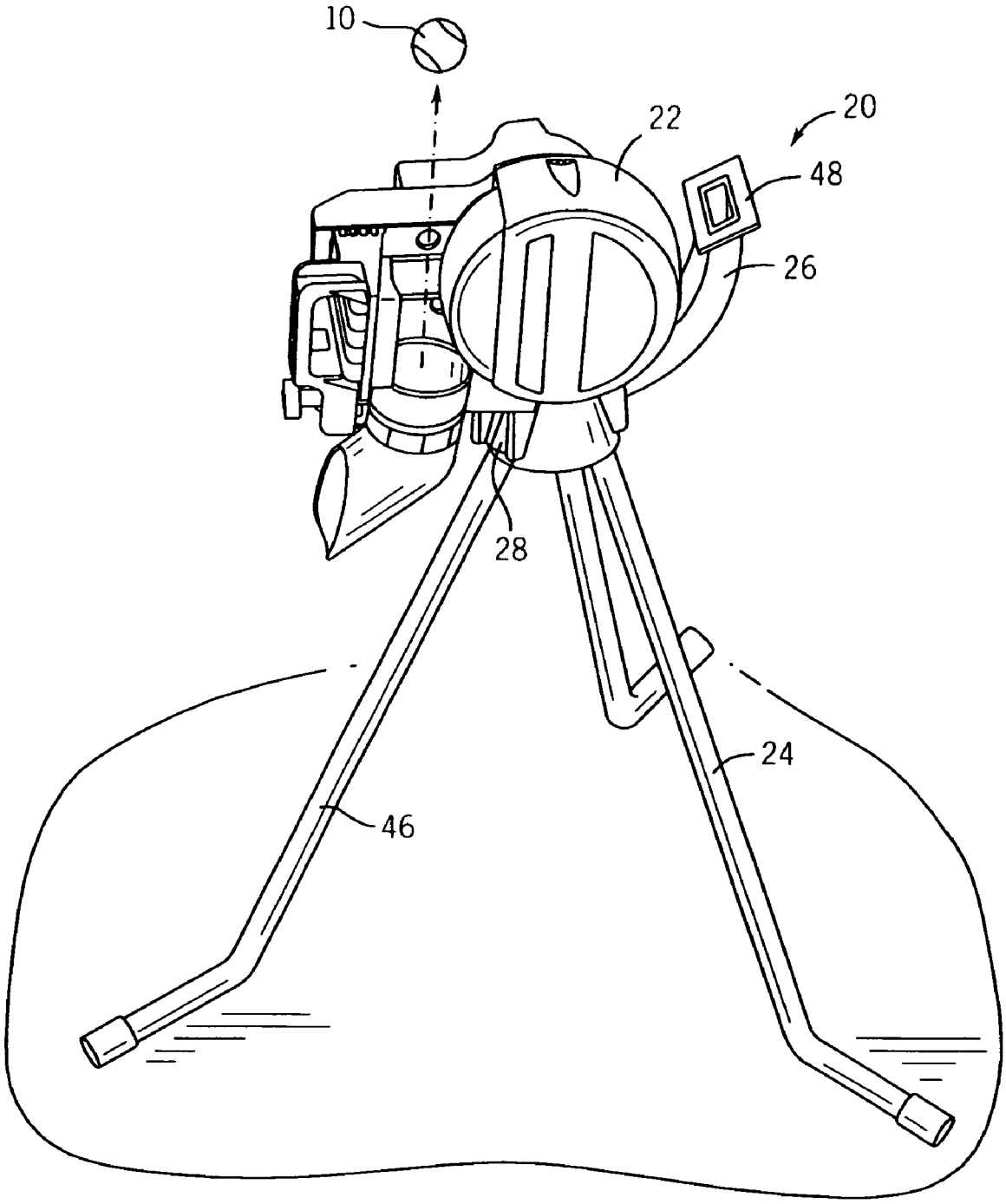
FIG. 2 is another perspective view of the ball projecting machine.

FIG. 2 illustrates the ball projecting machine 20 with the C-shaped arm 26 slid through the frame 28 such that the ball projecting head 22 is positioned to aim and project the ball 10 upwards in a generally vertical initial path of travel. In the embodiment illustrated in FIG. 2, a portion of the C-shaped arm 26 is flattened in an area adjacent to the ball projecting head 22, which allows the ball projecting head 22 to be positioned to pitch or project the ball 10 upward in a generally vertical initial path of travel and to produce a "pop-up" ball path.

In a preferred embodiment, the ball projecting head 22 in combination with the C-shaped arm 26 has a center of gravity that is aligned approximately with the first axis 32 about which the ball projecting head 22 rotates. Consequently, the center of gravity of the ball projecting head 22 in combination with the C-shaped arm 26 facilitates stability and movement of the ball projecting machine 20 when the C-shaped arm 26 is slid up or down. This stability results in the ability to quickly, smoothly and easily adjust the length or elevation of pitched balls. This quick, smooth and easy movement enables a user to readily vary the angle of the ball projecting head and produce a variety of different ball paths in rapid succession, if desired. The position of the ball projecting head 22 can be adjusted even slightly, or "micro-adjusted," without the ball projecting head 22 tending toward a different direction. In contrast, conventional ball projecting machines typically have ball projecting heads, motors, wheels and other components that are positioned offset from the center of gravity of the ball projecting machine. These components are typically quite heavy making adjustment of the machine difficult. When adjustment mechanisms of such machines are loosened, a user must be careful to maintain contact and control of the machine. If the user releases contact or control of such a machine in a loosened condition, the ball projecting head and other components can cause the machine to tip over or for the ball projecting machine to drop to an undesirable position relative to the stand. Thus, the ball projecting head in a conventional pitching machine, when in an unlocked position, tends to rotate toward a position in which the center of gravity is as low as possible. With the center of gravity of the ball projecting head 22 in combination with the C-shaped arm 26 aligned with the first axis 32 about which the ball projecting head 22 rotates, the position of the ball projecting head 22 remains easily manipulated, even when in an unlocked position.

Figure 3:
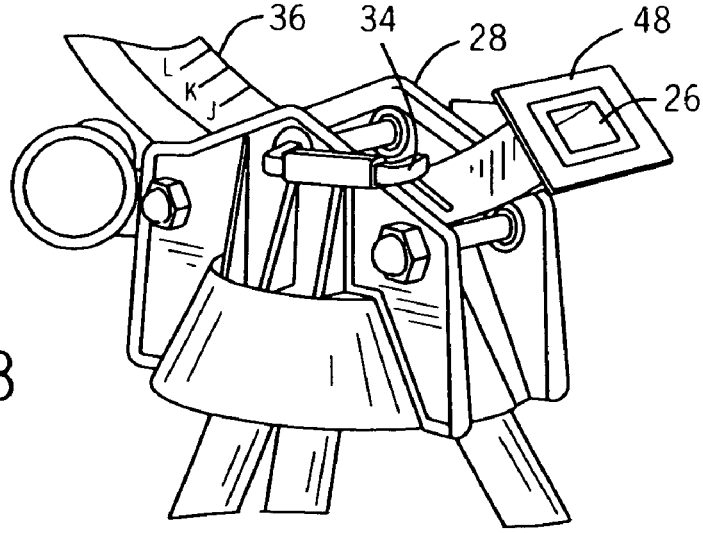
FIG. 3 is a partial view of the ball projecting machine showing a locking device.

To adjust the length or elevation of pitched balls, a user can loosen or unlock a first locking device 34, as shown in FIG. 3, and then, by hand, slide the C-shaped arm 26 up or down through the frame 28 to position the ball projecting head 22 to throw a desired type of pitch to a desired location. The ball projecting head 22 is preferably positioned directly above the first locking device 34. After setting the ball projecting head 22 at the approximated location, the user then locks the C-shaped arm 26 into position with the locking device 34 and throws test pitches. Any suitable adjustment mechanism can be used to maintain the C-shaped arm 26 in place. In one preferred embodiment, the first locking device 34 is an over center cam locking mechanism. For example, the first locking device 34 may include a lever that engages and disengages a press-fit connection, or a Bullet press-fit connection, for example. The press-fit connection, when disengaged, allows the C-shaped arm 26 to slide up or down through the frame 28. The first locking device 34 is positionable between a locked position wherein the frame 28 affixes to one of a plurality of locations about the C-shaped arm 26, and an unlocked position wherein the C-shaped arm 26 is slidably movable relative to the frame 28 between the plurality of locations along the C-shaped arm 26.

In preferred embodiment, an end of travel stop 48 is coupled to the free second end of the C-shaped arm to prevent the C-shaped arm 26 from sliding or otherwise moving entirely through the frame 28 when the first locking device 34 is in an unlocked position. The stop 48 prevents the C-shaped arm from inadvertently separating from the stand 24 or the frame 28.

After the test pitch, the pitch location may be fine-tuned by making further minor adjustments in the same manner described above. As explained above, the location of the center of gravity of the ball projecting head 22 in combination with the C-shaped arm 26 maintains stability even as the ball projecting head 22 is rotated along the length of the C-shaped arm 26. The ball projecting head 22 remains substantially centered over the stand 24 throughout the range of adjustment of the ball projecting machine 20. Thus, further micro-adjustments can be made smoothly and easily.

At least one visible indicator 36 may be located on the C-shaped arm 26 for positioning the ball projecting head 22, as illustrated in FIG. 3, in one of a plurality of different positions with respect to the frame 28. More particularly, when a user wishes to replicate a specific pitch location or delivery point, the user can simply note the location of the C-shaped arm 26 with respect to the indicator 36. In one embodiment, the at least one visible indicator 36 can be a plurality of score lines. In other preferred embodiments, the at least one visible indicator can take other forms, such as, for example, other shaped marks, a series of alphanumeric designators, a number of different colored regions, a number of different patterned regions, and combinations thereof. In other alternative embodiments, one or more separate indicators can be positioned on a portion of the frame 28 or stand 24 to designate the angular position of the ball projecting head 22 with respect to the frame or stand. The indicators 36 can be used to note when the desired pitch location is achieved, the user notes the location of the scored line with respect to the corresponding letter or number or other indicia on the indicator 36. Then, after adjusting the position of the ball projecting head 22 for subsequent practice plays, the user can return to the earlier pitch simply by realigning the C-shaped arm 26 to the earlier noted position on the indicator 36 and, if necessary, subsequently making any micro-adjustments necessary to fine-tune the pitch location. For example, a coach may run many different routines or drills with this machine 20, many of which require different delivery points. The delivery points may change from drill to drill, which requires movement of the ball projecting head 22 up or down to different positions. By providing a visible indicator 36 for positioning the ball projecting head 22, the coach can go back quickly to a drill by knowing the alphanumeric or other marked position of the ball projecting head 22.

In certain embodiments, the ball projecting head 22 is rotatable about a second axis 38. In a preferred embodiment, the second axis 38 is a generally vertical axis. In fact, the ball projecting head 22 may be rotatable 360 degrees about the second axis 38. A second locking device 58 is used to fix the position of the ball projecting head 22 with respect to the second axis 38, or to enable the ball projecting head 22 to be repositionable about the second axis 38. The second locking device 38 is configured to allow for a user to quickly and easily loosen the second locking device 58, reposition the ball projecting head 22 with respect to the second axis, and re-secure the ball projection head 22 to the frame 28. A press-fit connection or any other suitable type of adjustment mechanism may be used to control the side-to-side rotation of the ball projecting head 22 about the second axis 38. Additionally, a visible indicator may be located on the stand 24, the frame 28, or the ball projecting head 22 in order to replicate the left-right alignment of pitches in the same manner described above with respect to the alignment indicator 36 used for replicating the height and angle positioning of the ball projecting head 22.

The ball projecting head 22 is also adjustably rotatable about a third axis 56. In a preferred embodiment, the ball projecting head 22 is rotatable by approximately 270 degrees about the third axis 56. Rotation of the ball projecting head 22 about the third axis 56 enables a user to pitch curve balls or project balls at different curved directions. A third locking device is positioned at the connection of the ball projection head 22 to the C-shaped arm 26. The third locking device is configured to allow for a user to quickly and easily loosen the third locking device, reposition the ball projecting head 22 with respect to the third axis 56, and re-secure the ball projection head 22 to the C-shaped arm 26.

The ball projecting machine 20 is designed to withstand heavy usage on a playing field. Various components may be constructed of a durable high-tech composite material, metal or steel. In certain embodiments, the outer surface of the C-shaped arm 26 can be formed of a rigid material such as a plating to strengthen the bearing surfaces of the C-shaped arm 26. For example, the C-shaped arm can be zinc-plated for enhanced durability. In other embodiments, the components of the ball projecting machine 20 can be formed of other metals, polymeric and/or composite materials.

Some of the aforementioned parts of the ball projecting machine 20 can be used as additions to existing product designs with minor modifications to the current parts. In general, the ball projecting machine 20 includes the ball projecting head 22 situated atop the stand 24, which may include a tripod formed of three legs 46. The ball projecting head 22 includes a first motor-driven wheel 40 spaced apart from an opposing surface 42 by a distance slightly less than to a diameter of a ball (e.g., a baseball, a softball or a practice ball having a diameter similar to that of a conventional baseball or softball), such that the first wheel 40 and the opposing surface 42 are situated closely enough to one another to grip the ball, yet the grip is loose enough to allow the ball to rotate in cooperation with rotation of the first wheel 40. The present design also imparts a spin onto the projected ball.

The opposing surface 42 may either be a stationary surface or, alternatively, a surface on a second wheel (not shown) that rotates at the same speed, a different speed or counter-rotates with respect to the first wheel 40. In embodiments including a first concave wheel 40 and a second concave wheel (not shown), each wheel may be driven by its own independent motor. The ability to independently vary the speed of each wheel provides the ball projecting machine 20 with exceptional ball control. Additionally, a variety of types of pitches can be achieved by varying the speed of the first and second motors thereby adjusting the speed and spin of the projected ball.

Figure 4:
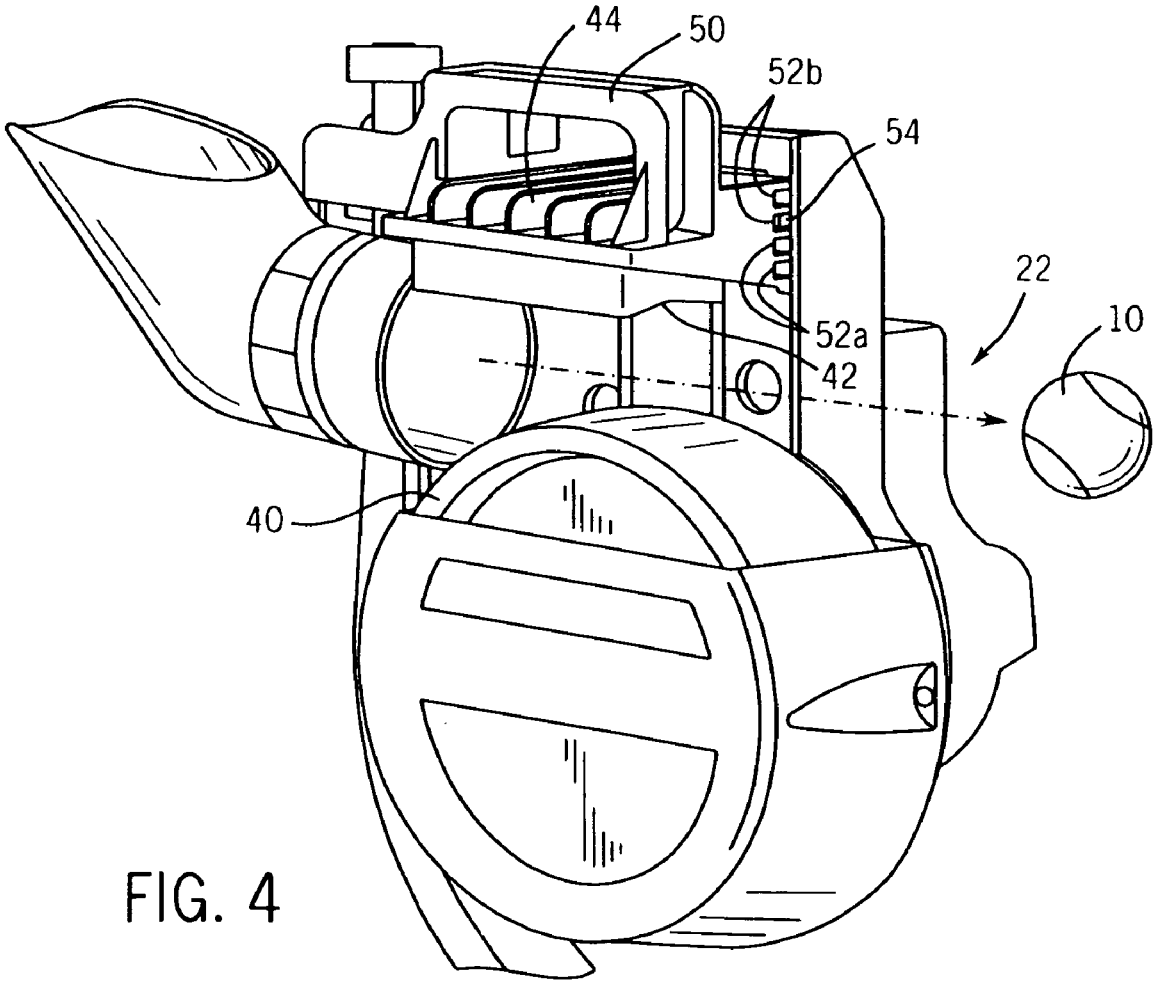
FIG. 4 is a side view of a ball projecting head.

In certain embodiments, the distance between the first wheel 40 and the opposing projecting surface 42 can be adjusted to accommodate different size balls, such as, for example, baseballs and softballs. For example, the ball projecting head 22 may include an adjustable pinch pad 44, as illustrated in FIG. 4, that can be adjusted to accommodate different size balls. In a preferred embodiment, the pinch pad 44 includes a plurality of grooves 52 and the ball projecting head 22 includes a rib 54 configured to engage one of the grooves. The pinch pad 44 is adjustable on the ball projecting head such that the pinch pad 44 can be positioned to align one of the grooves 52*a* and 52*b* with the rib 54. In the embodiment illustrated in FIG. 4, four grooves 52*a* and 52*b* are formed in the pinch pad 44 thereby providing four adjustment positions for the pinch pad 44 with respect to the wheel 40. The two grooves 52*a* positioned closer to the wheel 40 are intended for baseballs and the two grooves 52*b* positioned furthest from the wheel 40 are intended for softballs. Two grooves are provided for each ball size to vary the distance of the pinch pad 44 from the wheel 40 for the same size ball. The smaller distance of the two available grooves per ball size enables the ball pitching machine 20 to impart greater spin onto the ball than the larger distance of the two available grooves per ball size. In alternative embodiments, other configurations for adjusting the position of the ball projecting surface 42 of the pinch pad 44 with respect to the wheel 40 can be used. For example, a rib can extend from the pinch pad and engage one of a plurality of grooves formed in the ball projecting head. A variety of fungible accessories, such as baseball and softball retainers, feeders and chutes, may also be used with the ball projecting machine 22.

Figure 5:
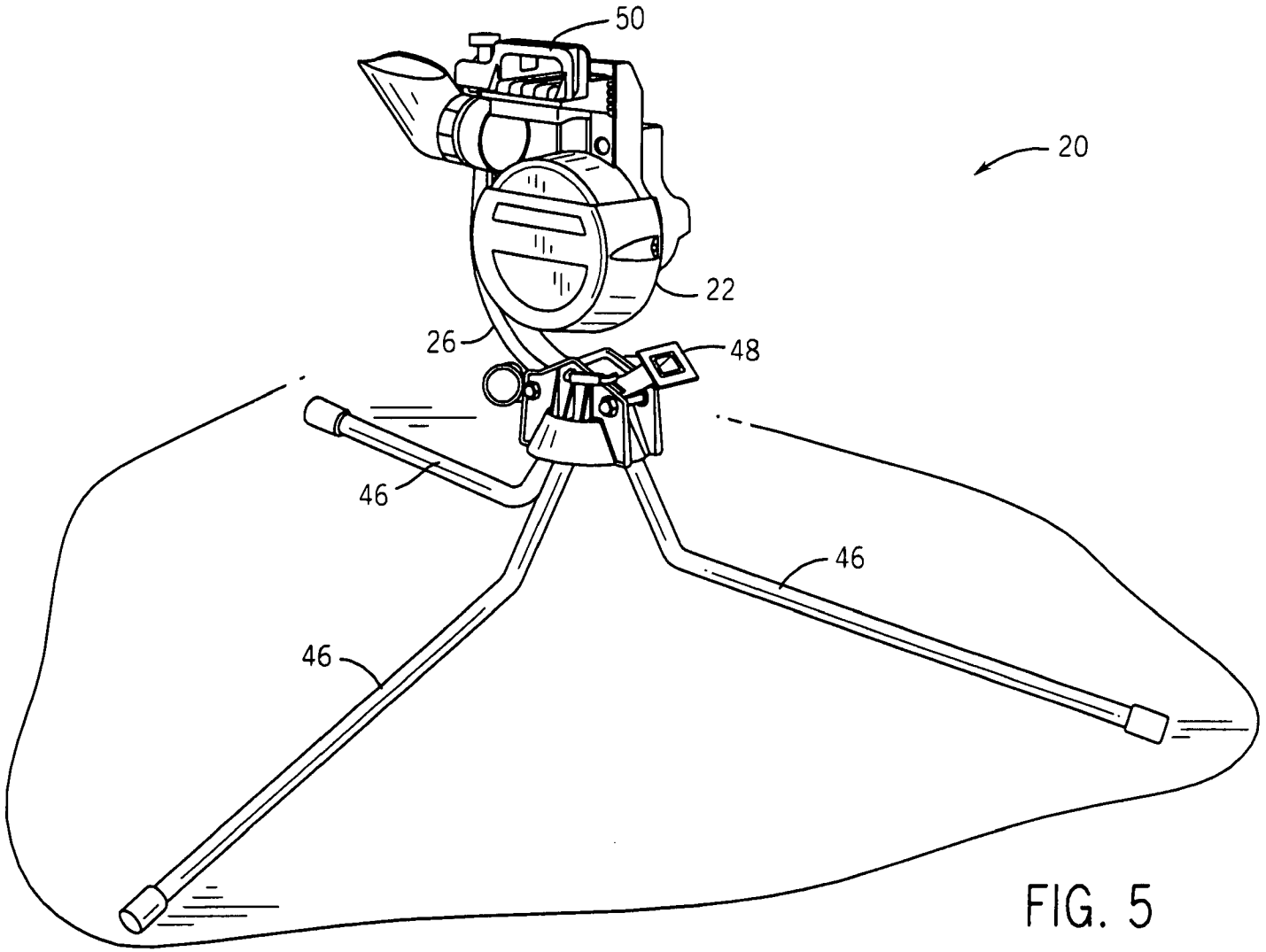
FIG. 5 is a perspective view of a ball projecting machine suitable for softball.

The ball projecting machine 20 is preferably configured to accommodate different types of balls. The stand 24 preferably includes the three legs 46 forming a tripod. Referring to FIGS. 1 and 5, the legs 46 can be positioned in a baseball position and a softball position. The release points of pitched balls in baseball and softball vary. The release point of a pitched ball in baseball is higher than in softball. Therefore, in the baseball position as shown in the FIG. 1, the legs 46 are positioned to elevate the ball projecting head 22 to a level at least three feet off the ground. In softball, the pitcher's wind-up results in an under-arm type motion and a lower release point than baseball. In the softball position as shown in FIG. 5, the legs 46 are reversed such that the overall height of the ball projecting head 22 with respect to the ground is lower thereby providing an optimal height for simulating softball pitches. Such adjustments in height of the machine 20 through the positioning of the legs 46 can provide different release points for the projected ball from the machine 20. The same set of legs 46 can be used to provide two different heights for the ball projecting machine 20.

In alternative embodiments, the legs may be quick-release legs that telescopically extend and retract, or the legs may be removed and reinserted upside down to provide a different configuration. These features can be used to adjust the height of the stand 24 as well as to create a more compact design when moving or storing the ball projecting machine 20. Additionally, the various parts of the ball projecting machine 20 may be modular so that individual parts can be removed easily in case any of the parts need to be serviced in the field by the user. The legs 48 can also be removed from the stand 24 to facilitate transportation or relocation of the ball projecting machine 20. The ball projecting head 22 further includes a handle 50 that also facilitates relocation or transportation of the ball projecting machine 20. The handle 50 also facilitates adjustably repositioning of the ball projecting head 22 about the first, second and/or third axes 32, 38 and 56.

The C-shaped arm 26 of the ball projecting machine 20 can be adjusted to provide a full range of pitched balls for baseballs as well as softballs. Examples of types of pitches that can be thrown by the ball projecting machine 20 include fastballs, drop balls, left-handed curve balls, right-handed curve balls, left-handed sliders, right-handed sliders, breaking balls, fly balls, pop-ups, catcher's pop-ups, line drives, and grounders. As known by those skilled in the art, the projection of a ball changes with speed. The design of this ball projecting machine 20 can provide accurate pitches at variable speeds, ranging up to about 60 miles per hour (mph) for baseballs and up to about 55 mph for softballs. The C-shaped arm design may be applied to ball projecting machines for other types of balls as well, such as tennis balls.

The above-described features of the ball projecting machine 20 provide enhanced stability for adjusting the pitch location. In particular, by sliding the C-shaped arm 26 up or down within the frame 28 of the ball projecting machine 20, the machine 20 can make longer or shorter, higher or lower pitches. The center of gravity of the C-shaped arm 26 facilitates stability of the adjustment.

While the preferred embodiments of the invention have been illustrated and described, it will be appreciated that various changes can be made therein without departing from the spirit and scope of the invention. For example, while the embodiments described herein are illustrated in a ball projecting machine for pitching or projecting baseballs, the principles of the present invention could also be used for ball projecting machines for pitching practically any other type of ball. Accordingly, it will be intended to include all such alternatives, modifications and variations set forth within the spirit and scope of the appended claims.

What is claimed is:

1. A ball projecting machine for projecting a ball, comprising:

a frame including a stand and at least a first locking device;

a ball projecting head positioned apart from the frame, the ball projecting head including a first wheel for contacting the ball and a motor that drives the first wheel; and a generally C-shaped arm having first and second ends, the C-shaped arm being coupled at the first end to the ball projecting head, the C-shaped arm slidably engaging the frame at the first locking device, the first locking device positionable between a locked position wherein the frame affixes to one of a plurality of spaced-apart locations along the C-shaped arm between the first and second ends, and an unlocked position wherein the C-shaped arm is slidably movable relative to the frame between the plurality of locations along the C-shaped arm.

2. The ball projecting machine of claim 1 wherein the ball projecting head is positioned directly above the first locking device.

3. The ball projecting machine of claim 2, wherein, when the first locking device is in an unlocked position, the weight of the ball projecting head facilitates movement of the C-shaped arm between the plurality of locations along the C-shaped arm.

4. The ball projecting machine of claim 1, wherein the ball projecting head further includes a projecting surface positioned apart from the first wheel by a distance roughly equal to a diameter of the ball.

5. The ball projecting machine of claim 1, wherein the first locking device comprises a lever configured to produce a press-fit connection between the frame and the C-shaped arm.

6. The ball projecting machine of claim 1, wherein the sliding of the C-shaped arm through the frame provides a range of angular adjustment of the ball projecting head position about a first axis that extends for at least 90 degrees, and wherein the plurality of locations correspond to the at least 90 degrees of angular adjustment.

7. The ball projecting machine of claim 1, wherein the sliding of the C-shaped arm through the frame provides a range of angular adjustment of the ball projecting head position about a first axis that extends for at least 135 degrees, and wherein the plurality of locations correspond to the at least 135 degrees of angular adjustment.

8. The ball projecting machine of claim 1, wherein the C-shaped arm further includes a travel stop coupled to the second end and configured to prevent the C-shaped arm from separating from the frame.

9. The ball projecting machine of claim 6 wherein the first axis is a generally horizontal axis.

10. The ball projecting machine of claim 1, wherein the ball projecting head is rotatable 360 degrees about a second axis.

11. The ball projecting machine of claim 10, wherein the second axis is a generally vertical axis.

12. The ball projecting machine of claim 4, wherein the position of the projecting surface is adjustable with respect to the first wheel to accommodate different sizes of balls.

13. The ball projecting machine of claim 1, wherein the C-shaped arm further comprises at least one visible indicator for positioning the C-shaped arm with respect to the frame at one of the plurality of the ball locations.

14. The ball projecting machine of claim 1, wherein the stand comprises legs that are readily adjustable to accommodate either baseball or softball applications.

15. The ball projecting machine of claim 1, wherein a portion of the generally C-shaped arm adjacent to the ball projecting head is flattened to enable the ball projecting machine to produce a generally vertical initial ball path of motion out of the ball projecting machine.

16. The ball projecting machine of claim 1, wherein the ball projecting head is configured to produce a variety of different ball paths of motion, and wherein the ball paths of motion can be selected from the group consisting of: fastballs, drop balls, curve balls, sliders, breaking balls, fly balls, pop-ups, catcher's pop-ups, line-drives, and ground balls.

17. A ball projecting machine for projecting a ball, comprising:

a ball projecting head spaced apart from and situated atop a stand, the ball projecting head including a first wheel spaced apart from an opposing surface by a distance roughly equal to a diameter of a ball, and a motor that drives the first wheel;

a generally C-shaped arm that connects the ball projecting head to the stand, wherein the ball projecting head is affixed to one end of the C-shaped arm, and the C-shaped arm is slidably engaged through a frame atop the stand to allow rotation of the ball projecting head about a horizontal axis, wherein a center of gravity of the ball projecting head in combination with the C-shaped arm facilitates movement of the ball projecting machine when the C-shaped arm is slid up or down; and a locking device with a press-fit connection that, when disengaged, allows the C-shaped arm to slide up or down through the frame.

18. The ball projecting machine of claim 17, wherein the ball projecting head is rotatable about a vertical axis.

19. The ball projecting machine of claim 17, further comprising a visible indicator on the C-shaped arm for positioning the C-shaped arm with respect to the frame at one of a plurality of locations about the C-shaped arm.

20. The ball projecting machine of claim 17, wherein a portion of the generally C-shaped arm adjacent to the ball projecting head is flattened to enable the ball projecting machine to produce a generally vertical initial ball path of motion.

* * * * *